US006159071A

United States Patent [19]

Koma et al.

[11] Patent Number: 6,159,071

[45] Date of Patent: Dec. 12, 2000

[54] SEMICONDUCTOR WAFER GRINDING APPARATUS

[75] Inventors: Yutaka Koma; Motomi Kitano; Takashi Kouda, all of Tokyo, Japan

[73] Assignee: Disco Corporation, Tokyo, Japan

[21] Appl. No.: 09/335,922

[22] Filed: Jun. 18, 1999

[30] Foreign Application Priority Data

Jul. 2, 1998 [JP] Japan ..... 10-187207

[51] Int. Cl.[7] ..... B24B 49/08

[52] U.S. Cl. ..... 451/5; 451/24

[58] Field of Search ..... 451/5, 24, 11, 451/288, 287

[56] References Cited

U.S. PATENT DOCUMENTS

| | | | |
|---|---|---|---|
| 3,872,626 | 3/1975 | White | 451/285 |
| 5,567,199 | 10/1996 | Huber et al. | 451/285 |
| 5,605,488 | 2/1997 | Ohashi et al. | 451/288 |
| 5,816,895 | 10/1998 | Honda | 451/41 |
| 5,916,016 | 6/1999 | Bothra | 451/388 |
| 5,944,580 | 8/1999 | Kim et al. | 451/288 |

*Primary Examiner*—Robert A. Rose

*Attorney, Agent, or Firm*—Arent Fox Kitner Plotkin & Kahn PLLC

[57] ABSTRACT

Disclosed is an improved semiconductor wafer grinding apparatus comprising at least wafer holding means and wafer grinding means. The wafer holding means comprises a holder having a wafer-gripping surface for sucking and holding a selected semiconductor wafer and liquid bearing means for rotatably supporting the holder. The liquid bearing means has inclination control means formed therein, and the inclination control means includes discrete inclination controlling areas for suspending the holder at upper and lower levels. Each inclination controlling area has flow rate control means connected thereto. The parallelism of the wafer-gripping surface relative to the wafer grinding means is assured by controlling the flow rate of the liquid to each inclination controlling area.

5 Claims, 7 Drawing Sheets

SEMICONDUCTOR WAFER GRINDING APPARATUS

BACKGROUND OF THE INVENTION

1. Field of the Invention

The present invention relates to an apparatus for grinding semiconductor wafers, and more particularly to means for keeping a semiconductor wafer, which is fixedly held on the wafer-gripping surface, parallel to the grinding surface of the grinding means in the semiconductor wafer grinding apparatus.

2. Description of Related Art

FIG. 8 shows a conventional grinding apparatus 100 having a semiconductor wafer holder 117 and a grinding means 107 set up on its L-shaped stand. A screw rod 102 is rotatably fixed to the rear side of the vertical wall 101 of the L-shaped stand, extending parallel to the vertical wall 101. The screw rod 102 is driven by an associated power drive 103 so that its movable part 104 may be moved up and down. The movable part 104 has a slide 105 integrally connected thereto for moving on vertical rails 106 laid on the front side of the vertical wall 101. The slide 105 carries grinding means 107. The vertical position of the movable part 104 can be determined by a linear scale 108, which is fixed to the rear side of the vertical wall 101.

The grinding means 107 comprises a spindle 109 and a spindle housing 110 for rotatably holding the spindle 109, which has a grindstone mount 111 on its end. The grindstone mount 111 has a grinding wheel 113 fixed to its bottom, and a grindstone 112 is attached to the grinding wheel 113, which can be rotated by the spindle 109.

The rotary holder 117 is positioned on the base 114 of the L-shaped stand. It can be rotated by an associated servomotor 116, which has an encoder 115 equipped therewith. The wafer-gripping surface 118 of the rotary holder 117 can hold a semiconductor wafer by applying a negative pressure to the semiconductor wafer. The rotary holder 117 is seated on a support member 119, which has three level adjusting screws 120 equal angular distance apart from each other, thereby permitting the wafer-gripping surface 118 to be set parallel to the grindstone 112.

In operation a selected semiconductor wafer is put on the wafer-gripping surface, which is sucked and fixedly held thereon. The spindle 109 is put in rotation, and at the same time, the grinding means 107 is lowered. The spindle 109 is rotated at high speeds, and accordingly the grinding wheel 113 is rotated at high speeds. The rotating grindstone 112 is pushed against the semiconductor wafer to make its surface smooth by rubbing on the hard grindstone 112.

In grinding it is required that the grinding accuracy be increased to the extent that the wafer has an even thickness over its whole area with keeping the total thickness variation (TTV) constant as possible. To meet this requirement it is necessary that the wafer-gripping surface 118 is put in exact parallelism relative to the undersurface of the grindstone 112.

The rotary holder 117 and the grinding means 107 are set up very carefully to assure the strict parallelism as required therebetween. No matter how carefully these parts may be set up, however, a minimum misalignment in the order of several microns cannot be reduced. To reduce such a minimum misalignment the three leveling screws 120 are used in the grinding apparatus 100.

As a recent tendency the degree of integration in semiconductor devices has been increasing, and the semiconductor wafer size has been increasing, too. Accordingly it is required that the permissible minimum misalignment be reduced to the order of nanometer. The leveling screws 120, however, cannot meet such requirement.

SUMMARY OF THE INVENTION

One object of the present invention is to provide a grinding apparatus equipped with means for putting semiconductor wafers in most strict parallelism relative to the undersurface of the grindstone.

To attain this object an apparatus for grinding semiconductor wafers comprising at least means for holding semiconductor wafers and means for grinding semiconductor wafers is improved according to the present invention in that said means for holding semiconductor wafers comprises holder means having wafer-gripping surface for sucking and holding semiconductor wafers and liquid bearing means for rotatably supporting said holder means, said liquid bearing means having inclination control means formed therein, said inclination control means including first, second and third sets of inclination controlling areas for suspending said holder means, each having first and second pockets formed at upper and lower levels, said first set of inclination controlling area having a first flow rate control means connected thereto, said second set of inclination controlling area having a second flow rate control means connected thereto, and said third set of inclination controlling area having a third flow rate control means, whereby the parallelism of said wafer-gripping surface relative to said means for grinding is assured by controlling the flow rate of the liquid to each of said first, second and third sets of inclination controlling areas.

Said first, second and third sets of inclination controlling areas may have first, second and third channels respectively connected to a pressurized liquid supply in common, said first, second and third channels having first, second and third flow rate controlling means equipped therewith.

Each of said first, second and third flow rate controlling means may include a liquid inlet, first and second liquid outlets and a branching section for separating the flow of liquid from said liquid inlet and for directing the flow of liquid thus separated to said first and second liquid outlets, said first and second liquid outlets being connected to said first and second pockets respectively.

Each of said first, second and third flow rate controlling means may include a cylinder, a piston slidably fitted in said cylinder with a very narrow gap left therebetween, thereby defining said branching section, said piston having means for setting the initial position thereof in said cylinder, said cylinder having said liquid inlet formed at its intermediate section, and said first and second liquid outlets formed at its opposite sides, thereby permitting the liquid from said liquid inlet to flow to said first and second liquid outlets via said very narrow gap, whereby the flow rates to said first and second liquid outlets may be controlled by permitting the liquid to flow in said very narrow gap in opposite directions and by adjusting the distances of said very narrow gap passage from said liquid inlet to said first and second liquid outlets. Said liquid may be water.

With the above described arrangement the holder means is supported at three selected areas at which the flow rates of the liquid to be supplied there are so controlled that the wafer-gripping surface may be put in the parallelism of nanometer order relative to the bottom surface of the grindstone.

The parallelism as required can be easily attained simply by controlling the flow rates of the liquid to the three pockets, and the parallelism thus attained can be retained in stable condition. Water used in the liquid bearing has the effect of increasing the rigidity of the established suspension system, thereby permitting the parallelism once attained to be retained with precision, and advantageously there is no fear of contamination of semiconductor wafers.

Other objects and advantages of the present invention will be understood from the following description of a semiconductor wafer grinding apparatus having equipped with parallelizing means according to the present invention, one embodiment of which is shown in accompanying drawings.

DESCRIPTION OF THE PREFERRED EMBODIMENTS

Figure 1:
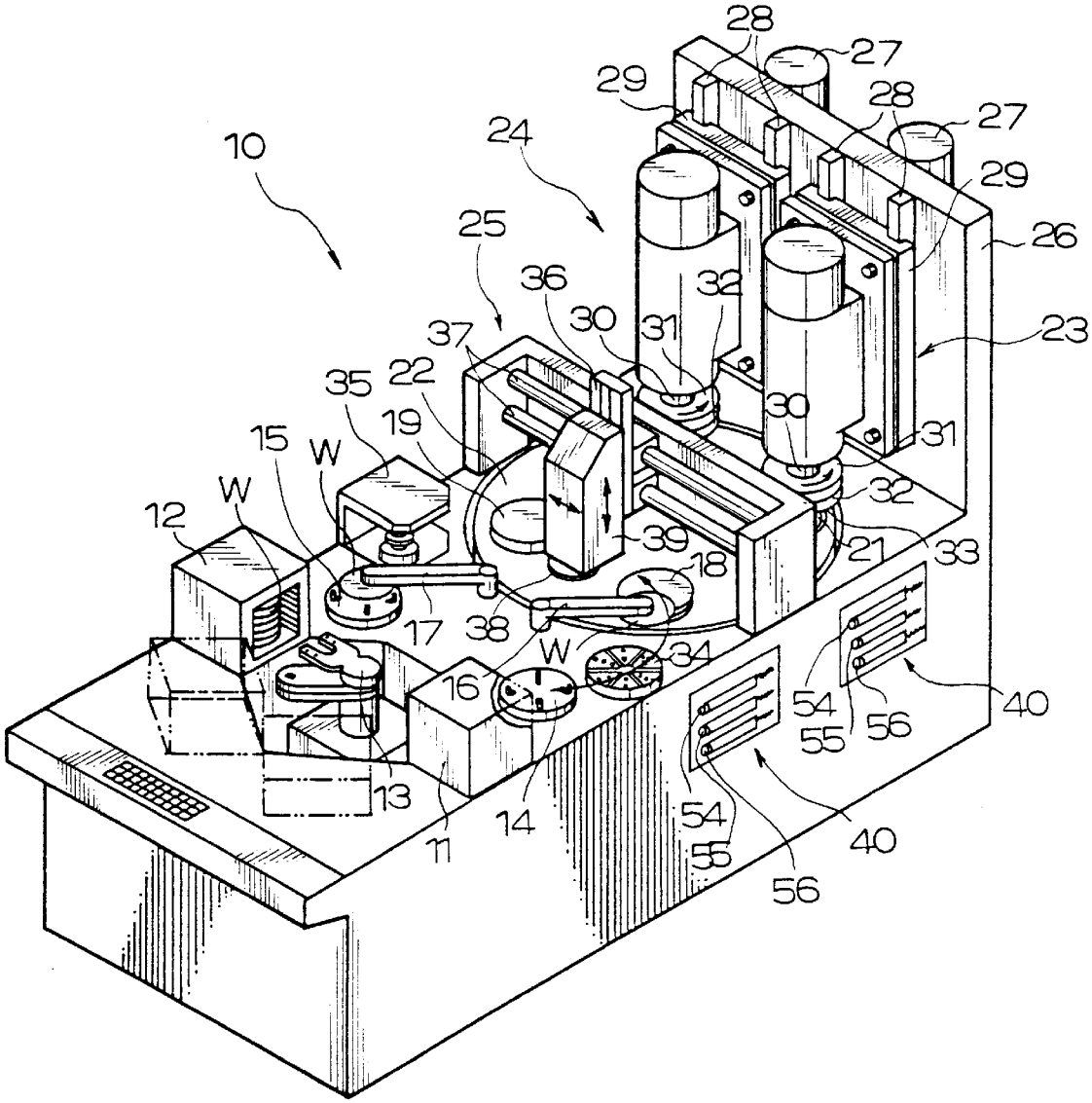
FIG. 1 is a perspective view of the grinding apparatus according to the present invention.

Referring to FIG. 1, a semiconductor wafer grinding apparatus 10 comprises: on its L-shaped stand, wafer cassettes 11 and 12 for storing semiconductor wafers W; means 13 for taking semiconductor wafers W out from the wafer cassette 11 and putting them in the wafer cassette 12; centering tables 14 and 15 for centering semiconductor wafers W; first and second transporting means 16 and 17; a turntable 22 having four holders 18 to 21 thereon, each holder having wafer-gripping surface for sucking and holding a selected semiconductor wafer W thereon; grinding means 23 and 24 for grinding semiconductor wafers W on the holders 18 to 21; and washing means 25 for washing each holder.

The cassette 11 contains a pile of wafers W to be ground, and these wafers W are brought one after another to the centering table 14 by the transporting means 13. After the required centering is effected on the wafer W, it is sucked by the first transporting means 16. Then, the first transporting means 16 is made to turn and bring the wafer W to the washing area 34. After the wafer W is washed there, it is put on a selected holder 18 in the turntable 22. The washing area 34 uses a disk having six brushes fixed thereon, permitting water to be flushed between adjacent brushes or from each brush while the disk is rotated.

When the turntable 22 is rotated a predetermined angle (for instance, 90 degrees if it has four holders as in this particular embodiment), a selected holder 18 bearing a semiconductor wafer W is brought under the coarse-grinding means 23, and then, the subsequent holder 19 is brought to the place which was occupied by the preceding holder 18. A subsequent semiconductor wafer W is taken out from the cassette 11 to be put on the centering table 14. After centering, the second wafer W is brought to the washing area 34. After the second wafer W is washed, it is put on the holder 19. The first wafer W is coarse-ground by the grinding means 23.

The turntable 22 is rotated another predetermined angle subsequent to the coarse-grinding of the first wafer W to bring and put the first wafer W under the fine-grinding means 24. The first wafer W is fine-ground there. At the same time, the subsequent wafer W is coarse-ground by the coarse-grinding means 23.

The coarse- and fine-grinding means 23 and 24 can be moved up and down on the vertical wall 26 of the L-shaped stand. These grinding means 23 and 24 are same in structure, and therefore their parts are indicated by same reference numerals in the following description. A pair of rails 28 are laid on the upright wall 26 to carry a slide plate 29, which can be driven along the rails 28 by an associated power drive 27. The grinding means 23 or 24 is fixed to the slide plate 29.

The grinding means 23 or 24 has a rotary spindle 30 rotatably supported in its housing, and the rotary spindle 30 has a grinding wheel 32 fixed to its end via an associated mount 31. The grinding wheel 32 has a grindstone 33 fixed to its bottom. The coarse-grinding means 23 has a coarse grindstone attached thereto whereas the fine-grinding means 24 has a fine grindstone attached thereto.

When the turntable 22 turns still another predetermined angle, the holder 18 bearing the fine-ground wafer W is brought close to the second transporting means 17, and then the fine-ground wafer is brought to the washing station 35 by the second transporting means 17. At the washing station 35 the wafer W is put on a spinner table while being washed with water. In place of water NaOH at a raised temperature ranging from 70 to 80 degrees C. may be used to remove grinding distortion or prominent saw marks, if any. After being washed the wafer is brought to the centering table 15 by the second transporting means 17.

After centering the wafer W, it is picked up and put in the cassette 12 by the transporting means 13. In this way semiconductor wafers are coarse- and fine-ground sequentially to be put in the cassette 12.

When the holders 18 to 21 are contaminated with debris, a holder washing station 25 is put in operation. It comprises a holder washing part 38, a carrier 36 for bearing and transporting the holder washing part 38, a pair of horizontal rails 37 and a vertical drive 39 for moving the holder washing part 38 up and down. In operation the holder washing part 38 is lowered close to holders to be washed, and the carrier 36 is made to traverse along the rails 37 a certain distance across the turntable 22 while the holder washing part 38 is rotated, thereby washing all holders 18 to 21 one after another.

As seen from FIG. 1, parallelism controlling panels 40 each allotted to each of the holders 18 to 21 appear on the opposite sides of the base of the L-shaped stand.

Figure 2:
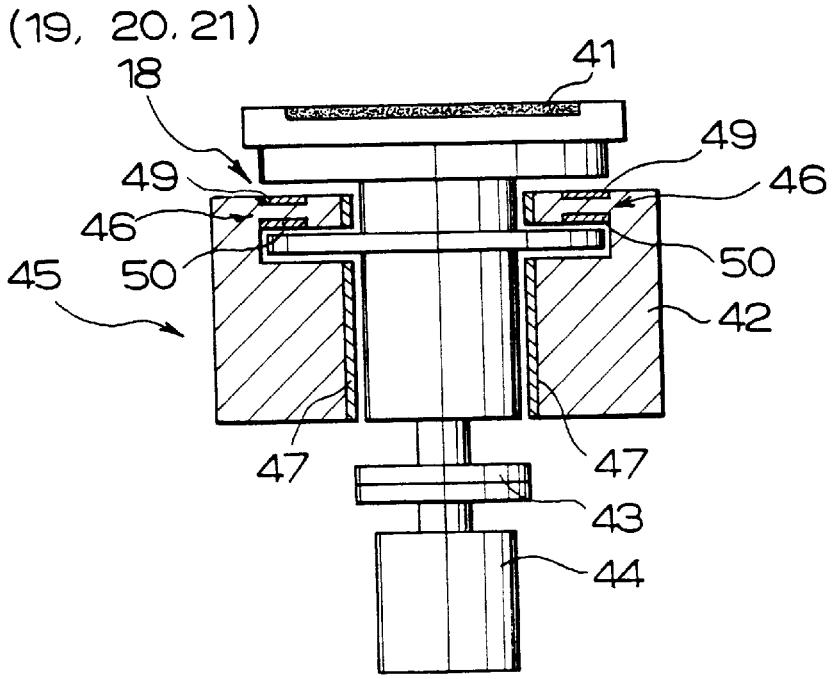
FIG. 2 illustrates the holder means of the grinding apparatus.

Referring to FIG. 2, the holder 18 (19, 20 or 21) has a wafer-gripping surface 41 on its top. The holder 18 is suspended rotatably by a liquid bearing device 42, and is connected to an associated servomotor 44 via a clutch 43. Thus, the holder 18 can be rotated by the servo motor 44 while being suspended by the liquid bearing device 42. The holder 18 (19, 20 or 21), the liquid bearing 42, the clutch 43 and the servo motor 44 make up together a wafer holding means 45.

The liquid bearing device 42 is a hollow cylinder having an annular U-shaped shelf formed close to its top, functioning as a thrust bearing to support the holder 18 (19, 20 or 21) vertically in floating condition. The thrust bearing functions as an inclination control means, too. In addition, a radial bearing 47 is formed on the inner surface of the center hole of the cylinder, thereby supporting the holder 18 (19, 20 or 21) radially.

Figure 3:
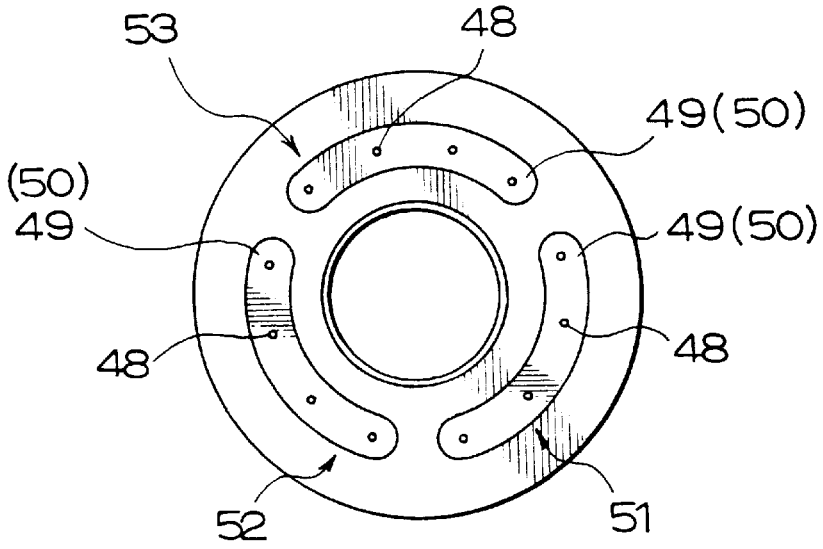
FIG. 3 is a plane view of the holder means, showing its inclination controls.

As seen from FIG. 3, the inclination control means 46 has a plurality of ejection ports 48 arranged in circular arcs both on the top and bottom surfaces of the annular shelf. These ejection ports 48 are grouped in three circular arc areas. The three circular arc areas on the top side of the annular shelf are called first pockets" 49 whereas the three circular arc areas on the bottom side of the annular shelf are called second pockets" 50. The first and second pockets aligned vertically make up first, second and third inclination controlling areas 51, 52 and 53.

Figure 4:
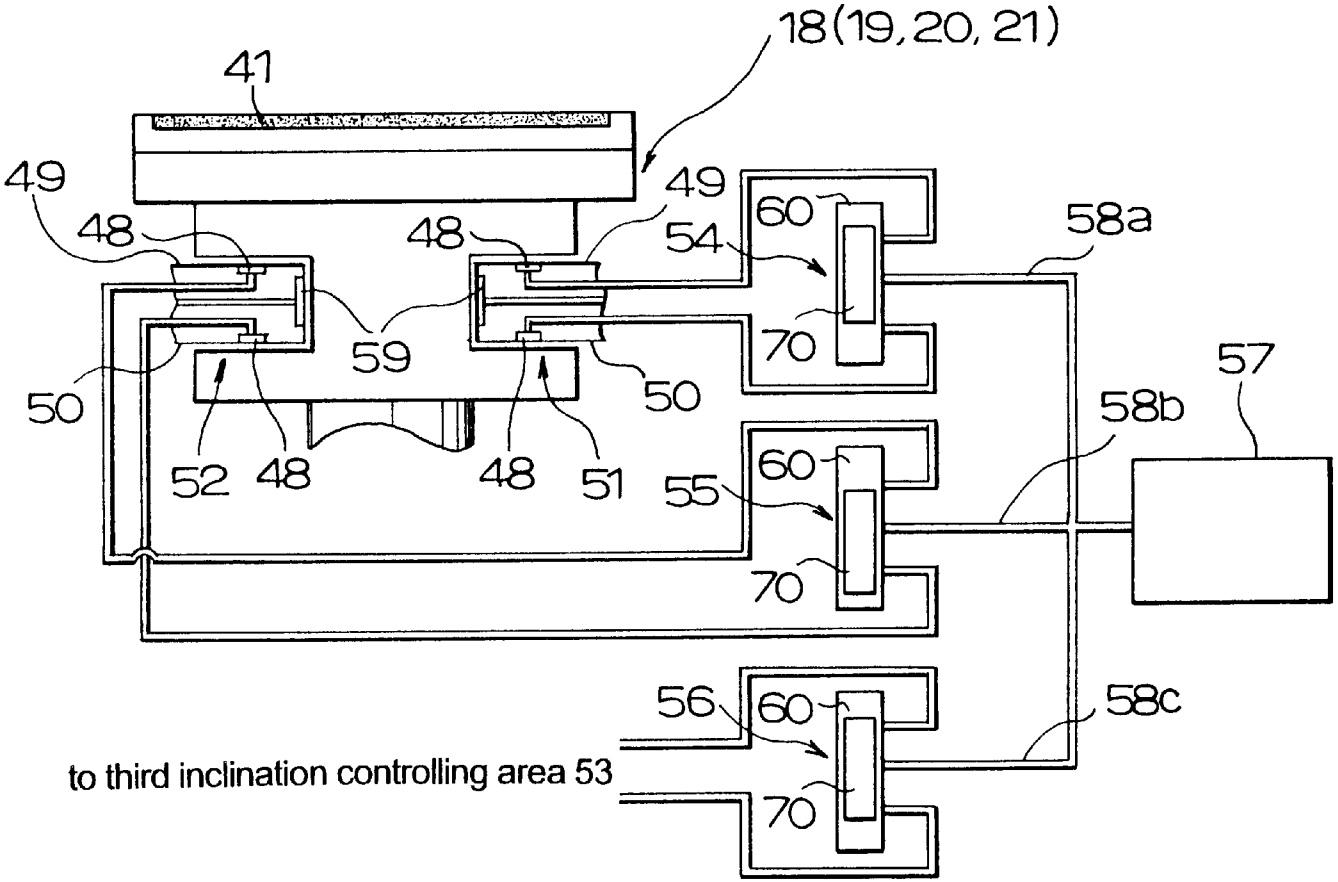
FIG. 4 shows how the holder means are connected to the pressurizing liquid supply via the flow rate control means.

Referring to FIG. 4, first, second and third flow rate control means 54, 55 and 56 are positioned in first, second and third feeding passages 58*a*, 58*b* and 58*c* extending from a pressurized liquid supply 57 to the first, second and third inclination controlling areas 51, 52 and 53 respectively, thereby permitting the liquid to be fed to the different areas at separately controlled pressure. Drainage ports 59 are formed to confront the rotary axle of the holder 18 (19, 20 or 21), thereby allowing the liquid to be discharged outward from the inclination controlling areas 51, 52 and 53.

Figure 5:
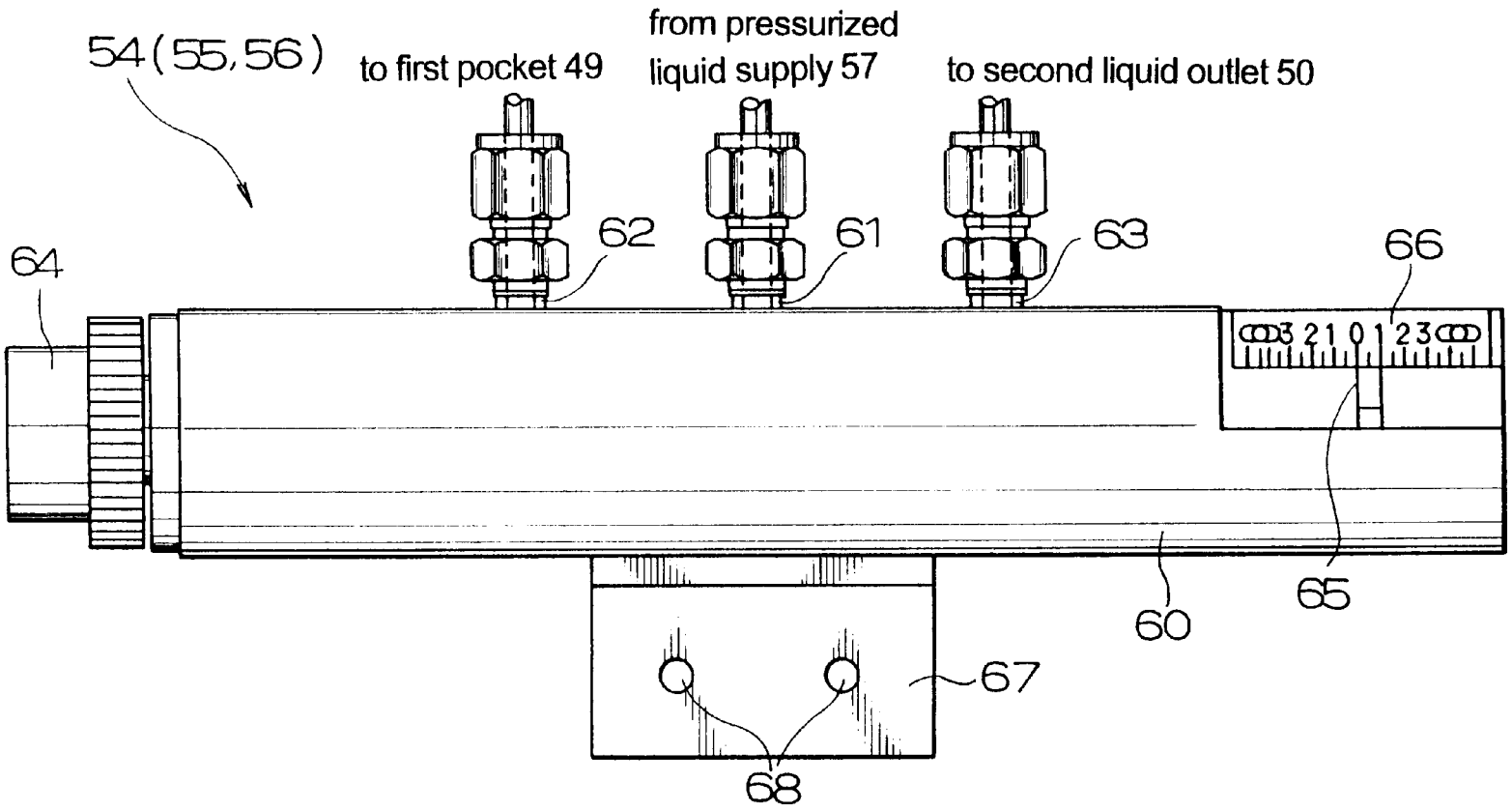
FIG. 5 is a front view of the flow rate control means.

Referring to FIG. 5, each flow rate controlling means 54, 55 or 56 is a piston-and-cylinder assembly, which has a liquid inlet 61 formed at the intermediate position of the cylinder 60, and first and second liquid outlets 62 and 63 formed at either side of the liquid inlet 61.

The cylinder 60 has a rotary knob 64 attached to its left end, and a scale 66 formed on its right side. The scale 66 has pointers 65 and 66 horizontally movable with rotation of the knob 64. The cylinder 60 has a bracket 67 fixed thereto, permitting the flow rate controlling means 54, 55 or 56 to be fixed to either side of the L-shaped stand, as indicated at 40 in FIG. 1.

Figure 6:
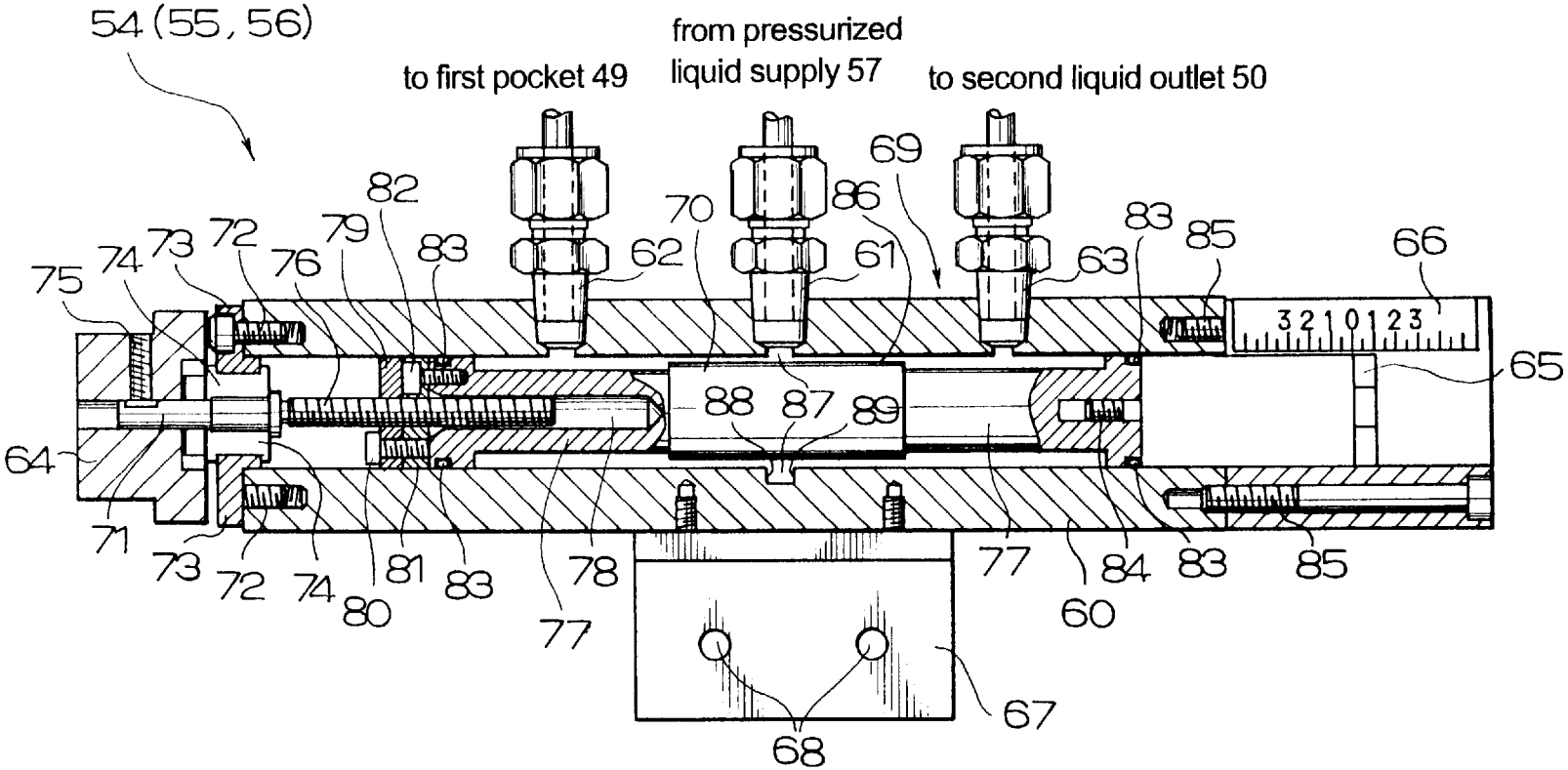
FIG. 6 is a longitudinal section of the flow rate control means.

Referring to FIG. 6, the flow rate controlling means 54, 55 or 56 has a branching section 69 for separating the flow of liquid from the liquid inlet 61 into two separate flows to direct to the first and second liquid outlets 62 and 63. When the liquid is made to flow into the branching section 69 from the pressurized liquid supply 57 through the liquid inlet 61, and then, the separate flows are discharged from the first and second liquid outlets 62 and 63. The liquid is directed from the first liquid outlet 62 to the first pocket 49, and from the second liquid outlet 63 to the second pocket 50. The liquid may be oil or water. Water is preferably used because it has the effect of increasing the rigidity of the liquid-suspension system to maintain the parallelism of the wafer-gripping surface 41 relative to the grindstone with good precision.

Specifically the branching section 69 is formed by the hollow cylinder 60 and the piston 70 movable therein. A rotary axle 71 projects from the left end of the cylinder 60 to be maintained horizontal by a flange 73, which is press-fitted and fixed to the left end of the cylinder 60 with bolts 72. The rotary axle 71 is rotatably supported a radial bearing 74, and it has a knob 64 fixed to its end. The knob 64 may be positively fixed to the rotary axle 71 by inserting and driving a screw in its tapped hole 75 until the screw has abutted against the rotary axle 71.

The rotary axle 71 has a screw rod 76 integrally connected thereto, and the screw rod 76 is inserted in the elongated cavity 78 of one of the opposite shafts 77 of the piston 70 in non-contact condition. The screw rod 76 can be rotated by rotating the knob 64. The piston shaft 77 has a cap 81 fixed to its end by bolts 82, and a nut 79 is fixed to the cap 81 by bolts 80. The screw rod 76 is threadedly engaged with the nut 79. Thus, rotation of the knob 64 causes the nut 79 to move horizontally through the agency of the rotary screw rod 76, and accordingly the piston shaft 77 moves horizontally. Each piston shaft 77 has O-ring 83 fixed to its end to prevent leakage of water.

As seen from FIG. 6, the piston 70 is larger in diameter than either shaft 77. The right shaft 77 has a pointer 65 fixed to its right end with a stud bolt 84. It is moved horizontally with the shaft 77 to indicate the instantaneous position on the scale 66, which is fixed to the right end of the cylinder 60 with a stud bolt 85.

A very narrow gap 86 of several tens of micrometers is defined between the piston 70 and the hollow cylinder 60, thereby allowing the liquid flowing in the cylinder 60 from the liquid inlet 61 to the first and second liquid outlets 62 and 63. As shown in FIG. 6, the hollow cylinder 60 has an annular groove 87 made at its center, thereby permitting the liquid flowing in the hollow cylinder 60 to run on the circumference of the piston 70.

Figure 7:
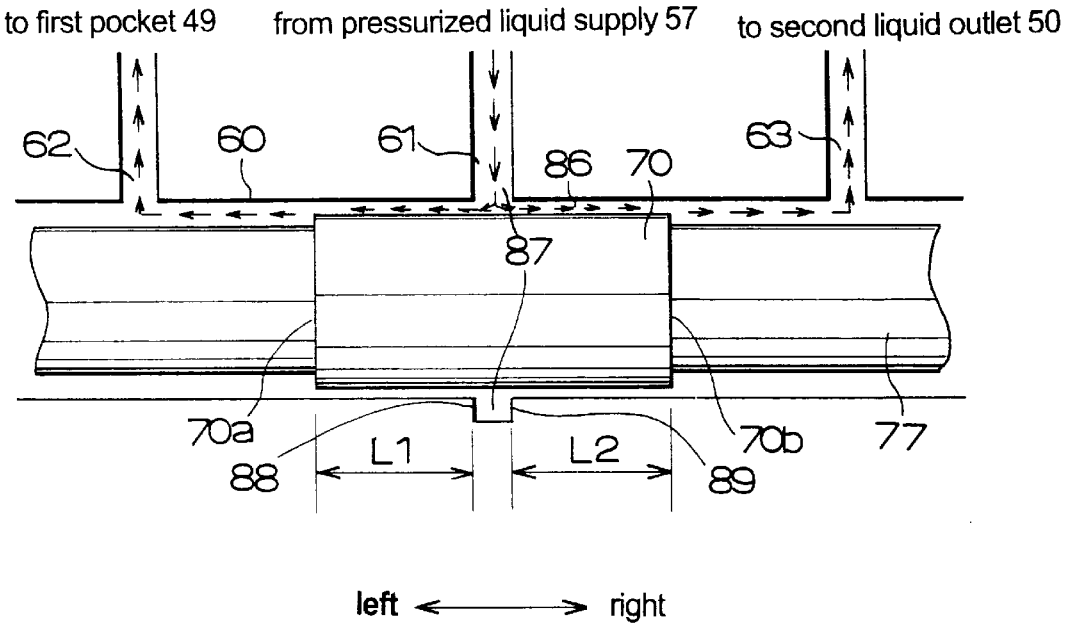
FIG. 7 illustrates how the liquid flows into the flow rate control means to be separated and discharged.
Figure 8:
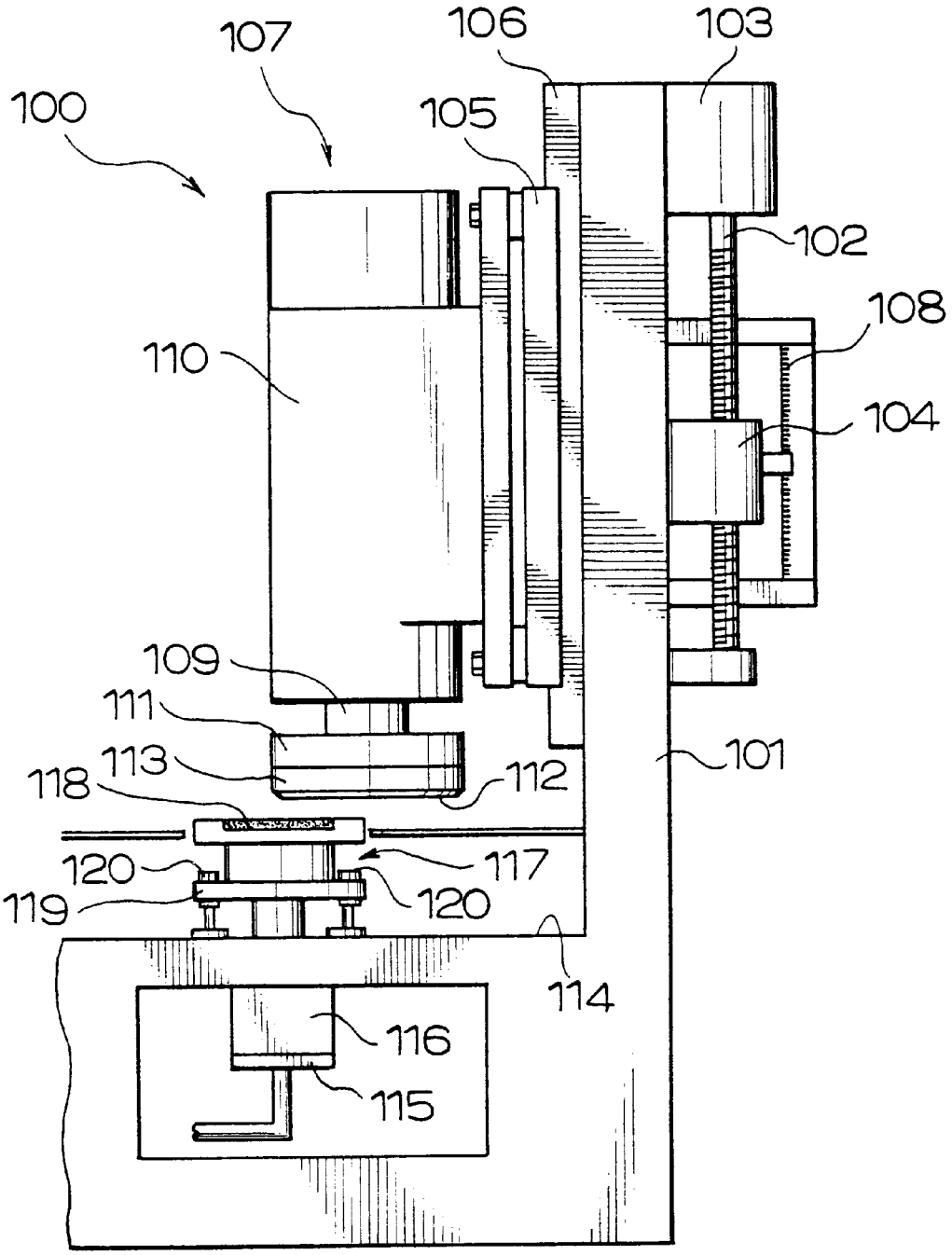
FIG. 8 PRIOR ART
FIG. 8 illustrates a conventional grinding apparatus.

Referring to FIG. 7, the circumferential gap 86 is L1 plus L2 long, where L1 stands for the length measured from the left side wall 88 of the annular groove 87 to the left end 70*a* of the piston 70, and L2 stands for the length measured from the right side wall 89 of the annular groove 87 to the right end 70*b* of the piston 70. These lengths L1 and L2 vary with the instantaneous position of the piston 70 relative to the liquid inlet 61.

The flow rate of the liquid directed from the liquid inlet 61 to the first liquid outlet 62 varies inversely with the gap length L1, and the flow rate of the liquid directed from the liquid inlet 61 to the second liquid outlet 63 varies inversely with the gap length L2. Specifically when the center of the piston 70 is put in alignment with the center of the annular gap 87, the flow rate from the first liquid outlet 62 is equal to that from the second liquid outlet 63 (equilibrium condition). When the piston 70 is shifted rightward (L1<L2), the flow rate from the first liquid outlet 62 is larger than in equilibrium condition, and the flow rate from the second liquid outlet 63 is smaller than in equilibrium condition. Conversely when the piston 70 is shifted leftward (L1>L2), the flow rate from the first liquid outlet 62 is smaller than in equilibrium condition, and the flow rate from the second liquid outlet 63 is larger than in equilibrium condition.

As the knob 64 is rotated to move the piston 70, the ratio of the flow rate from the first liquid outlet 62 to that from the second liquid outlet 63 varies, and accordingly the ratio of the amount of liquid ejecting from the ejection ports 48 of the upper, first pocket 49 to that of liquid ejecting from the ejection ports 48 of the lower, second pocket 50 varies, and accordingly the inclination of the holder, and hence the wafer-gripping surface 41 varies so that its parallelism may be controlled relative to the confronting grindstone 33. The worker can determine the instantaneous position of the piston from the pointer 65 and the scale 66 to know how the liquid is distributed.

As may be understood from the above, the flow rates from the first and second liquid outlets 62 and 63 can be controlled simply by rotating the knob 64 for changing the distances L1 and L2 from the liquid inlet 61 to the first and second liquid outlets 62 and 63, thus permitting the parallelism of the wafer-gripping surfaces 41 relative to the grindstone to be controlled in the order of nanometer, beyond what would be possible with the conventional screw adjustment as described above.

The flow rate controlling means is preferably connected to the inclination controlling means for instance, by using a rotary joint, which is fixed to the rotary axle of the turntable 22 lest the joint should interfere with rotation of the turntable.

As may be apparent from the above, a semiconductor wafer grinding apparatus according to the present invention has wafer holders each suspended at three points, particularly in three sets of inclination controlling areas, in which the liquid is distributed at controlled pressure to put the wafer-gripping surface in strict parallelism relative to the confronting grindstone with such a precision that the conventional mechanical adjustment cannot attain, say in the order of nanometer. Accordingly semiconductor wafers thus ground can have equal thickness (constant TTV), meeting the requirements for production of semiconductor devices of high-quality, which are composed of semiconductor wafers with integrated circuits built at high densities therein, or production of semiconductor wafers of large diameter.

The parallelism as required can be provided simply by controlling the flow rates of liquid. This facilitates the required inclination-controlling in such a stable fashion that semiconductor wafers of one and same quality can be provided.

When water is used in the liquid bearing, the stiffness of the bearing system is made large enough to assure that the parallelism of the wafer-gripping surfaces relative to the counter grindstones is maintained with good precision, and advantageously semiconductor wafers cannot be contaminated even if they are wet with water.

What is claimed is:

1. An apparatus for grinding semiconductor wafers comprising at least means for holding semiconductor wafers and means for grinding semiconductor wafers, wherein said means for holding semiconductor wafers comprises holder means having wafer-gripping surface for sucking and holding semiconductor wafers and liquid bearing means for rotatably supporting said holder means, said liquid bearing means having inclination control means formed therein, said inclination control means including first, second and third sets of inclination controlling areas for suspending said holder means, each having first and second pockets formed at upper and lower levels, said first set of inclination controlling area having a first flow rate control means connected thereto, said second set of inclination controlling area having a second flow rate control means connected thereto, and said third set of inclination controlling area having a third flow rate control means, whereby the parallelism of said wafer-gripping surface relative to said means for grinding semiconductor wafers is assured by controlling the flow rate of the liquid to each of said first, second and third sets of inclination controlling areas.

2. An apparatus for grinding semiconductor wafers according to claim 1, wherein said first, second and third sets of inclination controlling areas have first, second and third channels respectively connected to a pressurized liquid supply in common, said first, second and third channels having first, second and third flow rate controlling means equipped therewith.

3. An apparatus for grinding semiconductor wafers according to claim 2, wherein each of said first, second and third flow rate controlling means includes a liquid inlet, first and second liquid outlets and a branching section for separating the flow of liquid from said liquid inlet and for directing the flow of liquid thus separated to said first and second liquid outlets, said first and second liquid outlets being connected to said first and second pockets respectively.

4. An apparatus for grinding semiconductor wafers according to claim 3, wherein each of said first, second and third flow rate controlling means includes a cylinder, a piston slidably fitted in said cylinder with a very narrow gap left therebetween, thereby defining said branching section, said piston having means for setting the initial position thereof in said cylinder, said cylinder having said liquid inlet formed at its intermediate section, and said first and second liquid outlets formed at its opposite sides, thereby permitting the liquid from said liquid inlet to flow to said first and second liquid outlets via said very narrow gap, whereby the flow rates to said first and second liquid outlets may be controlled by permitting the liquid to flow in said very narrow gap in opposite directions and by adjusting the distances of said very narrow gap passage from said liquid inlet to said first and second liquid outlets.

5. An apparatus for grinding semiconductor wafers according to any one of claims 1 to 4, wherein said liquid is water.

* * * * *